US006926617B2

(12) United States Patent
Oyama

(10) Patent No.: US 6,926,617 B2
(45) Date of Patent: Aug. 9, 2005

(54) GOLF CLUB SHAFT

(75) Inventor: Hitoshi Oyama, Hyogo (JP)

(73) Assignee: SRI Sports Limited, Kobe (JP)

( * ) Notice: Subject to any disclaimer, the term of this patent is extended or adjusted under 35 U.S.C. 154(b) by 0 days.

(21) Appl. No.: 10/387,531

(22) Filed: Mar. 14, 2003

(65) Prior Publication Data

US 2003/0176237 A1 Sep. 18, 2003

(30) Foreign Application Priority Data

Mar. 15, 2002 (JP) ..... 2002-072962

(51) Int. Cl.[7] ..... A63B 53/10
(52) U.S. Cl. ..... 473/319
(58) Field of Search ..... 473/319, 320

(56) References Cited

U.S. PATENT DOCUMENTS 5,093,162 A * 3/1992 Fenton et al. ..... 428/34.5
5,156,396 A 10/1992 Akatsuka et al.
5,437,450 A * 8/1995 Akatsuka et al. ..... 473/320
6,110,056 A * 8/2000 Yamamoto ..... 473/289
6,273,830 B1 * 8/2001 Takemura et al. ..... 473/319
6,306,047 B1 * 10/2001 Kusumoto ..... 473/319

FOREIGN PATENT DOCUMENTS

JP 6-165844 A 6/1994
JP 2001-46564 * 2/2001
JP 2001-62014 A 3/2001

* cited by examiner

*Primary Examiner*—Stpehen Blau
(74) *Attorney, Agent, or Firm*—Birch, Stewart, Kolasch & Birch, LLP

(57) ABSTRACT

A golf club shaft has an angular layer composed of prepregs in which a reinforcing fiber inclines to the axis of the golf club shaft; a plurality of straight layers composed of prepregs in which the reinforcing fiber is disposed substantially parallel with the axis of the golf club shaft. The reinforcing fiber of the prepreg at an inner side of the straight layer has an intermediate elasticity and a high strength. The tensile break strain of the prepreg at an outer side of the straight-layer is set higher than that of the prepreg at the inner side of the straight layer.

18 Claims, 7 Drawing Sheets

GOLF CLUB SHAFT

BACKGROUND OF THE INVENTION

1. Field to the Invention

The present invention relates to a golf club shaft. More particularly, the present invention relates to a golf club shaft composed of a laminate of a plurality of prepregs lightweight and having a high flexural strength and impact strength to prevent it from being broken.

2. Description of the Related Art

A golf club shaft composed of a plurality of prepregs containing a resin and a carbon fiber impregnated with the resin is widely used because the prepregs are lightweight and have a high strength and vibration-damping performance. The prepregs are molded by winding them around a molding mandrel to form the shaft.

Once many golfers played golf to compete in a race but nowadays want to play golf as leisure. Therefore there is a growing demand for a golf club that can be handled easily and for a golf club shaft that is lighter and softer.

To make the shaft lightweight, it is necessary to decrease the amount of carbon fiber to be used. Decreasing the amount of the carbon fiber causes the strength of the shaft to be lower. To allow the shaft to have an appropriate degree of rigidity, it is necessary to use the carbon fiber having a high modulus of elasticity. The carbon fiber having a high modulus of elasticity has a low elongation percentage (deformation amount before breakage). Thus as the modulus of elasticity of the shaft becomes higher, the strength, in particular, the compression strength thereof becomes decreasingly low. Even though the tensile modulus of elasticity of the shaft is increased, the compression strength thereof does not become high.

In the case where the shaft is allowed to have an appropriate degree of rigidity, the strength of the shaft, particularly, the compression strength thereof becomes low. Consequently the shaft becomes frail. When a flexural load and an impact load are applied to the shaft, the shaft is liable to be broken.

To overcome the above-described problems, various proposals of golf club shafts are made as being lightweight and having a high rigidity.

For example, the golf club shaft composed of carbon fiber reinforced resin is disclosed in Japanese Patent Application Laid-Open No. 5-49717. The golf club shaft has the inner layer composed of the angular layer inclining to the axis thereof and the outer layer composed of the inner and outer straight layers (two-layer structure) parallel with the axis thereof. The golf club shaft further includes the reinforcing layer disposed at the tip where the head is mounted and grip thereof. The carbon fiber of the inner straight layer of the two-layer structure has a high elasticity and strength, whereas the carbon fiber of the outer straight layer thereof has a high strength.

The golf club shaft disclosed in Japanese Patent Application Laid-Open No. 6-165844 has the compressive angular layer and the tensile angular layer. In the compressive angular layer inclining at an angle in a clockwise direction to the axis thereof, the PAN based carbon fiber having a high compressive modulus is used. In the tensile angular layer inclining at the angle in a counterclockwise direction to the axis thereof, pitch based carbon fiber having a high tensile modulus of elasticity is used.

The golf club shaft disclosed in Japanese Patent Application Laid-Open No. 2001-62014 is made of a composite prepreg partly containing an organic fiber combined with a carbon fiber having a low tensile modulus of elasticity of less than 1500 Pa.

In the golf club shaft disclosed in Japanese Patent Application Laid-Open No. 5-49717, the carbon fiber of the outer straight layer of the two-layer structure has a high strength, whereas the carbon fiber of the inner straight layer thereof is highly elastic. Therefore the golf club shaft is frail and easily broken.

In the golf club shaft disclosed in Japanese Patent Application Laid-Open No. 6-165844, the highly elastic carbon fiber is used. Thus the golf club shaft is also frail and easily broken.

In the golf club shaft disclosed in Japanese Patent Application Laid-Open No. 2001-62014, the specific composite prepreg containing the organic polymerized fiber combined with the carbon fiber having a low tensile modulus of elasticity. Thus the golf club shaft costs high. Further both the organic polymerized fiber and the carbon fiber having a low tensile modulus of elasticity have a comparatively high breaking elongation percentage but have a low tensile strength (tensile strength of organic polymerized fiber is about 3000 MPa, and tensile strength of low-modulus carbon fiber is in the range of 1100 to 2400 MPa). Therefore the composite prepreg is effective for improving the impact strength of the golf club shaft but does not allow it to have a sufficient flexural strength.

SUMMARY OF THE INVENTION

Thus the present invention has been made to solve the above-described problems of the above-described conventional golf club shafts.

Therefore it is an object of the present invention to provide a golf club shaft which has a laminate structure of prepregs and is lightweight, soft, and high in its flexural strength and impact strength and thus can be effectively prevented from being broken without greatly increasing the weight of the golf club shaft and rigidity distribution thereof.

To achieve the object, according to the present invention, there is provided a golf club shaft composed of a laminate of prepregs composed of a resin and a reinforcing fiber impregnated with the resin, comprising an angular layer composed of prepregs in which the reinforcing fiber inclines to an axis of the golf club shaft; and a plurality of straight layers disposed outside the angular layer and composed of prepregs in which the reinforcing fiber is disposed substantially parallel with the axis of the golf club shaft. The reinforcing fiber of the prepreg at an inner side of the straight layer has an intermediate elasticity and a high strength, and a tensile break strain of the prepreg at an outer side of the straight-layer is set higher than that of the prepreg at the inner side of the straight layer.

To obtain a shaft that is lightweight, soft, high in its flexural strength and impact strength, and not broken easily, the present inventors conducted experiments repeatedly by using various prepregs composed of a resin and fibers impregnated with the resin and by varying the kind of fibers, laminate structures, and angles of a reinforcing fiber and examined results of the experiment. As a result, they have made the golf club shaft having the above-described construction.

More specifically, the straight layer has a plurality of prepregs; the reinforcing fiber of the prepreg at the inner side of the straight layer has an intermediate elasticity and a high strength; and the tensile break strain of the prepreg at the outer side of the straight layer is set higher than that of the prepreg at the inner side of the straight layer. Thereby they have found that while keeping the shaft lightweight, soft, sufficiently rigid, it is possible to improve the flexural strength and impact strength thereof to thereby prevent it from being broken, without using a specific expensive prepreg.

In the case where two prepregs for the straight-layer are layered around the mandrel, they are taken as the inner prepreg and the other prepreg. In the case where four prepregs for the straight-layer are layered around the mandrel, one prepreg is taken as the inner prepreg, and the other three prepregs are taken as the outer prepreg; two prepregs are taken as the inner prepreg, and the other two prepregs are taken as the outer prepreg; or the three prepregs are taken as the inner prepreg, and the remaining one prepreg is taken as the outer prepreg.

That is, the prepreg reinforced with the fiber having an intermediate elasticity and a high strength is disposed at the inner side of the straight-layer, whereas the prepreg having a high tensile break strain is disposed at the outer side thereof.

Needless to say, the golf club shaft of the present invention is applicable to a golf club shaft having the angular layer, the straight-layer, and a reinforcing layer composed of prepregs layered one upon another at the tip of the shaft or/and the grip thereof.

The present invention is also applicable to a golf club shaft having a hoop layer in which a reinforcing fiber is disposed orthogonally to the axial direction of the golf club shaft.

As described above, by using a fiber having not a high modulus of elasticity but an intermediate modulus of elasticity and having a high strength as the fiber of the inner-side prepreg of the straight layer, it is possible to increase the elongation percentage of the fiber, obtain a sufficient rigidity, and keep a high strength. Since the outer-side prepreg of the straight layer has a large tensile break strain, the outer-side prepreg of the straight layer provides the shaft with a sufficient reinforcing effect. Consequently, even though a flexural load and an impact load are applied to the shaft, it is possible to prevent breakage of the shaft.

The fiber having an intermediate modulus of elasticity and a high strength of the prepreg at the inner side of the straight layer is made of composite fibers having a tensile modulus of elasticity in a range of 280 to 380 GPa and a tensile strength in a range of 4400 to 6500 MPa. The tensile break strain of the prepreg at the inner side of the straight layer is set to a range of 1.0% to 1.6%.

As the above-described fibers, carbon fiber is most effective. The following carbon fibers can be used: 825S (kind of carbon fiber: M30S) produced by Toray Industries, Inc., Q-A11H (kind of carbon fiber: IM400) produced by Toho Tenax Inc., MR350C (kind of carbon fiber: MR40) produced by Mitsubishi Rayon Inc.

The tensile break strain of the prepreg at the outer side of the straight layer is set to not less than 1.8%.

As the fiber of the prepreg at the outer side of the straight layer, the carbon fiber is effective, and the following carbon fibers can be effectively used: 325G (kind of carbon fiber: T700GC) produced by Toray Industries, Inc. and TR350C (kind of carbon fiber: TR50S) produced by Mitsubishi Rayon Inc.

It is preferable to dispose the straight layer from the tip of the shaft to its butt (grip end). But problems of rigidity and strength hardly occur at the tip of the shaft and the butt thereof particularly at the butt, even though the straight layer is not disposed thereat. Thus it is possible to form a straight layer-undisposed portion at the tip of the shaft and the butt thereof particularly at the butt. Therefore the straight layer should be disposed on the shaft at not less than 90%. The straight layer is disposed thereon favorably at not less than 95%, more favorably at not less than 98%, and most favorably from the tip of the shaft to its butt.

It is preferable to dispose the angular layer from the tip of the shaft to its butt (grip end). But problems of rigidity and strength hardly occur at the tip of the shaft and the butt thereof particularly at the butt, even though the angular layer is not disposed thereat. Thus it is possible to form an angular layer-undisposed portion at the tip of the shaft and the butt thereof particularly at the butt. Therefore the angular layer should be disposed on the shaft at not less than 90%. The angular layer is disposed thereon favorably at not less than 95%, more favorably at not less than 98%, and most favorably from the tip of the shaft to its butt.

According to the present invention, the reinforcing fiber of the straight layer forms an angle of less than ±15° to the axis of the shaft, and the reinforcing fiber of the angular layer forms an angle of not less than ±25° nor more than ±60° to the axis of the shaft.

The reinforcing fiber acts in such a way that its flexural rigidity is highest at an orientation angle of 0° to the axis of the shaft, and its torsional rigidity is highest at an orientation angle of ±45°. Thus if the reinforcing fiber of the straight layer forms an angle of not less than ±15° to the axis of the shaft, the flexural rigidity of the reinforcing fiber deteriorates. If the reinforcing fiber of the angular layer forms an angle of less than ±25° or more than ±60° to the axis of the shaft, the torsional rigidity of the reinforcing fiber deteriorates.

The impregnation degree of resin of each of the straight-layer prepreg and the angular-layer prepreg is set to a range of 15 wt % to 30 wt %, favorably 23 wt % to 30 wt %, and more favorably 23 wt % to 26 wt %.

That is, if the impregnation degree of resin is less than 15 wt %, the prepreg is not stabilized because the amount of the prepreg is small. Thus there is a large variation in the property of the shaft and its strength. Further it is difficult to adhere prepregs to each other. Thus the moldability is low. On the other hand, if the impregnation degree of resin is more than 30 wt %, it is difficult to make the shaft light.

Preferably, in the range of at least 100 mm from the tip of the golf club shaft, an intermediate layer composed of a pitch based low-elastic-modulus carbon fiber reinforced prepreg having a high tensile break strain is interposed between an inner-side prepreg of the straight layer and an outer-side prepreg of the straight layer, disposed on an inner surface of the inner-side prepreg of the straight layer or disposed on an outer surface of the outer-side prepreg of the straight layer.

Particularly, it is preferable to interpose the intermediate layer composed of the pitch based low-elastic-modulus carbon fiber reinforced prepreg having a high tensile break strain between the inner-side prepreg of the straight layer and the outer-side prepreg of the straight layer.

Normally, the compressive strength of the carbon fiber is lower than the tensile strength thereof. Thus breakage of the shaft is generated from the compressive side. Contrary to the other carbon fibers, the low-elastic-modulus pitch based carbon fiber has a characteristic that its compressive strength is higher than its tensile strength. Thus by disposing the low-elastic-modulus pitch based carbon fiber reinforced prepreg in the above-described regions, the strength of the compressive side is increased. Consequently the tensile strength and the compressive strength balance properly. Thereby it is possible to improve the flexural strength of the shaft and its impact strength.

As described above, it is possible to allow the tensile strength of the shaft to be higher by interposing the pitch based low-elastic-modulus carbon fiber reinforced prepreg between the inner-side prepreg of the straight layer and the outer-side prepreg of the straight layer than by disposing the pitch based low-elastic-modulus carbon fiber reinforced prepreg on the outer surface of the outer-side prepreg of the straight layer and allow the compressive strength of the shaft to be higher than by disposing the pitch based low-elastic-modulus carbon fiber reinforced prepreg on the inner surface of the inner-side prepreg of the straight layer.

The pitch based low-elastic-modulus carbon fiber reinforced prepreg can be disposed adjacently to the straight layer disposed longitudinally entirely on the shaft. However, if a lightweight shaft is desired to be manufactured, it is preferable to dispose the pitch based low-elastic-modulus carbon fiber reinforced prepreg in the range of at least 100 mm from the tip where the head is mounted.

The flexural load and the impact load are liable to be applied to the tip side. Thus by disposing a pitch based low-elastic-modulus carbon fiber layer having a tensile modulus of elasticity in the range of 50 GPa to 150 GPa in the range of at least 100 mm from the tip of the golf club shaft, it is possible to improve the flexural load and the impact load at the tip side. Thereby it is possible to prevent the shaft from being broken at the tip side where the shaft is more breakable than other portions thereof.

The ratio of the weight of the outer side prepreg of the straight layer to the total weight of the straight-layer prepreg is set to the range of 15 wt % to 35 wt %, and favorably 20 wt % to 30 wt %.

If the weight percentage is less than 15 wt %, it is impossible to obtain a sufficient reinforcing effect and thus impossible to improve the strength of the shaft. On the other hand, if the weight percentage is more than 35, it is impossible to obtain a sufficient rigidity and thus the strength of the shaft deteriorates.

The ratio of the weight of the shaft to the length thereof is set to less than 0.05 g/mm.

If the ratio is more than 0.05 g/mm, the weight of the shaft is large. Thus it is impossible to make the shaft lightweight. This is not preferable for golfers.

It is preferable that the shaft of the present invention has a length in the range of 850 mm to 1250 mm; the outer diameter of the shaft at its front end is in the range of $\phi$8.5 mm to $\phi$10.5 mm; and the outer diameter of the shaft at its rear end is in the range of $\phi$15.0 mm to $\phi$17.0 mm.

DETAILED DESCRIPTION OF THE PREFERRED EMBODIMENTS

The embodiments of the present invention will be described below with reference to the drawings.

Figure 1:
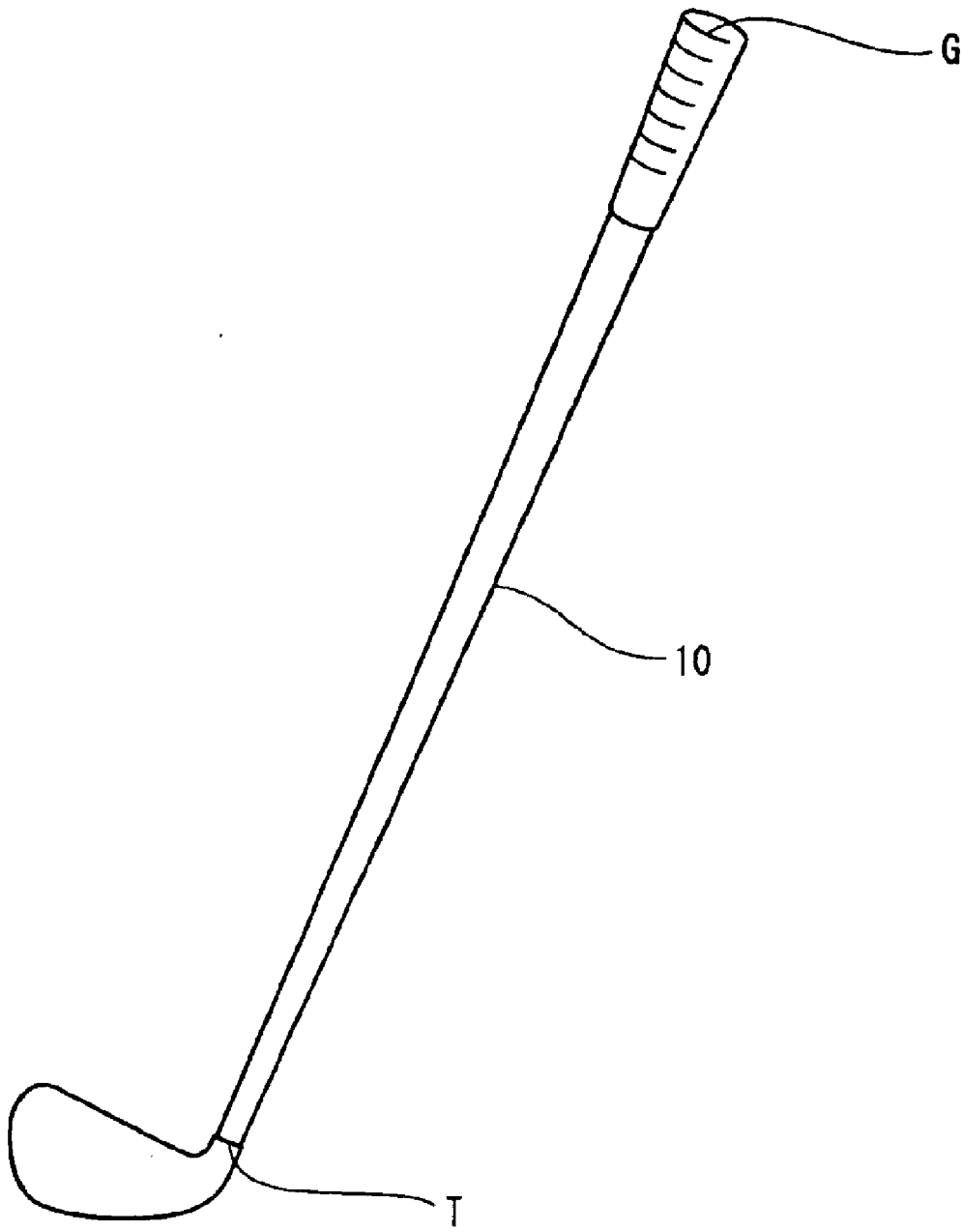
FIG. 1 is a front view showing a golf club shaft of the present invention.

FIG. 1 shows a golf club shaft 10 according to the present invention. The golf club shaft 10 is composed of a laminate of a plurality of prepregs containing a thermosetting resin (epoxy resin) and a carbon fiber impregnated with the thermosetting resin. After the prepregs are wound around a mandrel, they are thermoformed to form the hollow golf club shaft 10. The golf club shaft 10 is tapered off from a butt G at which a grip is mounted to a tip T at which a head is mounted.

Figure 2:
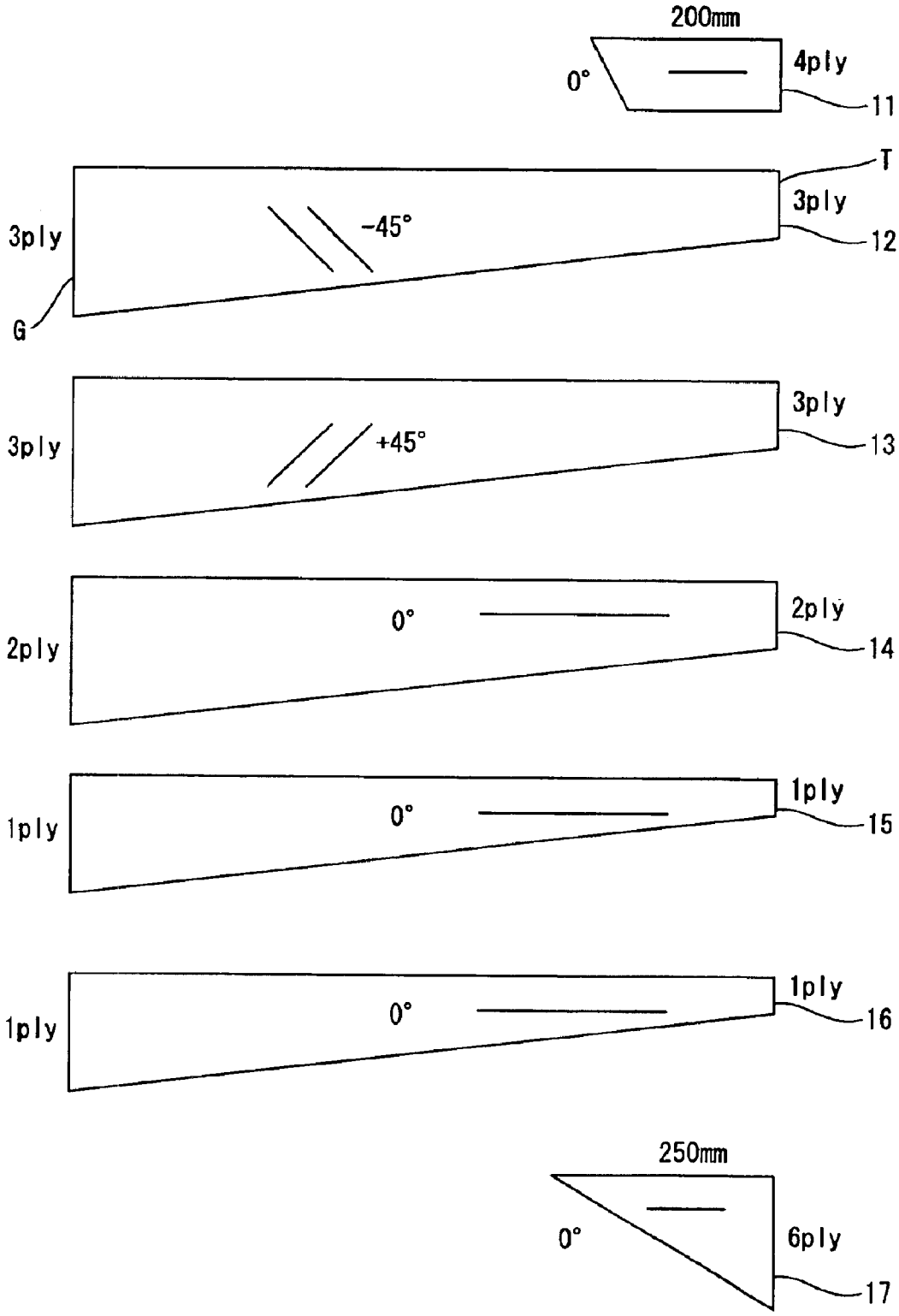
FIG. 2 shows prepregs for use in the golf club shaft of a first embodiment of the present invention.

In a first embodiment, the golf club shaft 10 is composed of a laminate of a plurality of prepregs shown in FIG. 2.

A prepreg disposed uppermost in FIG. 2 is disposed innermost in the golf club shaft 10, whereas a prepreg disposed lowermost in FIG. 2 is disposed outermost therein. The golf club shaft 10 is composed of a prepreg 11 constituting a straight layer and windingly disposed at the tip thereof to reinforce the tip; prepregs 12 and 13 constituting an angular layer and windingly disposed over the entire length thereof; prepregs 14, 15, and 16 constituting the straight layer and windingly disposed over the entire length thereof; and a prepreg 17 constituting the straight layer and windingly disposed at the tip thereof to reinforce the tip.

The carbon fiber of each of the straight-layer prepregs 11, 14, 15, 16, and 17 is substantially parallel with the axis of the shaft 10. The carbon fiber of each of the angular layer prepregs 12 and 13 forms an angle of −45° and +45° to the axis of the shaft 10 respectively.

An average impregnation degree of the resin of the prepreg constructing each of the straight layer and the angular layer is set to 26 wt %. The impregnation degree of the resin of the inner-side prepreg of the straight layer 14 to be disposed longitudinally entirely on the shaft is set to 25 wt %. The impregnation degree of the resin of each of the outer-side prepregs of the straight layer 15 and 16 to be disposed longitudinally entirely on the shaft is set to also 25 wt %.

The angular-layer prepregs 12 and 13 are wound at three continuous turns. The angular layer prepreg 13 is wound with two continuous turns of the straight-layer prepreg 14. The outer-side prepregs of the straight layer 15 and 16 are wound at one turn. The partial reinforcing straight-layer prepreg 11 to be disposed innermostly at the tip of the shaft is wound at four turns. The partial reinforcing straight-layer prepreg 17 to be disposed outermost is wound six turns.

The carbon fiber of each of the inner-side prepregs of the straight layer 14 and 15 to be disposed longitudinally entirely on the shaft has an intermediate tensile modulus of elasticity in the range of 280 to 380 GPa and a high tensile strength in the range of 4400 to 6500 MPa. The tensile break strain of each of the inner-side prepregs of the straight layer 14 and 15 is set to the range of 1.0% to 1.6%.

The tensile break strain of the outer-side prepreg of the straight layer 16 is set to not less than 1.8%

The ratio of the weight of the outer-side prepreg of the straight layer 16 to the total weight of the straight-layer prepregs 14, 15, and 16 is set to the range of 15 wt % to 35 wt %.

The prepregs 11 through 17 are composed of prepregs shown in table 1 shown later. Table 2 shows the kind, tensile modulus of elasticity, and tensile strength of the carbon fiber of each prepreg; the tensile break strain, compressive break strain, content of resin of each prepreg; and names of makers of the prepregs.

The shaft 10 has a length in the range of 850 mm to 1250 mm. The outer diameter of the shaft 10 at its front end is set to the range of ϕ8.5 mm to ϕ10.5 mm. The outer diameter of the shaft 10 at its rear end is set to the range of ϕ15.0 mm to ϕ17.0 mm. The ratio of the weight of the shaft to the length thereof is set to less than 0.05 g/mm.

The angular-layer prepregs 12 and 13 and the straight-layer prepregs 14, 15, and 16 are disposed longitudinally entirely on the shaft. The prepreg 11 is disposed in the range of 200 mm from the tip of the shaft. The prepreg 17 is disposed in the range of 250 mm from the tip thereof.

Figure 3:
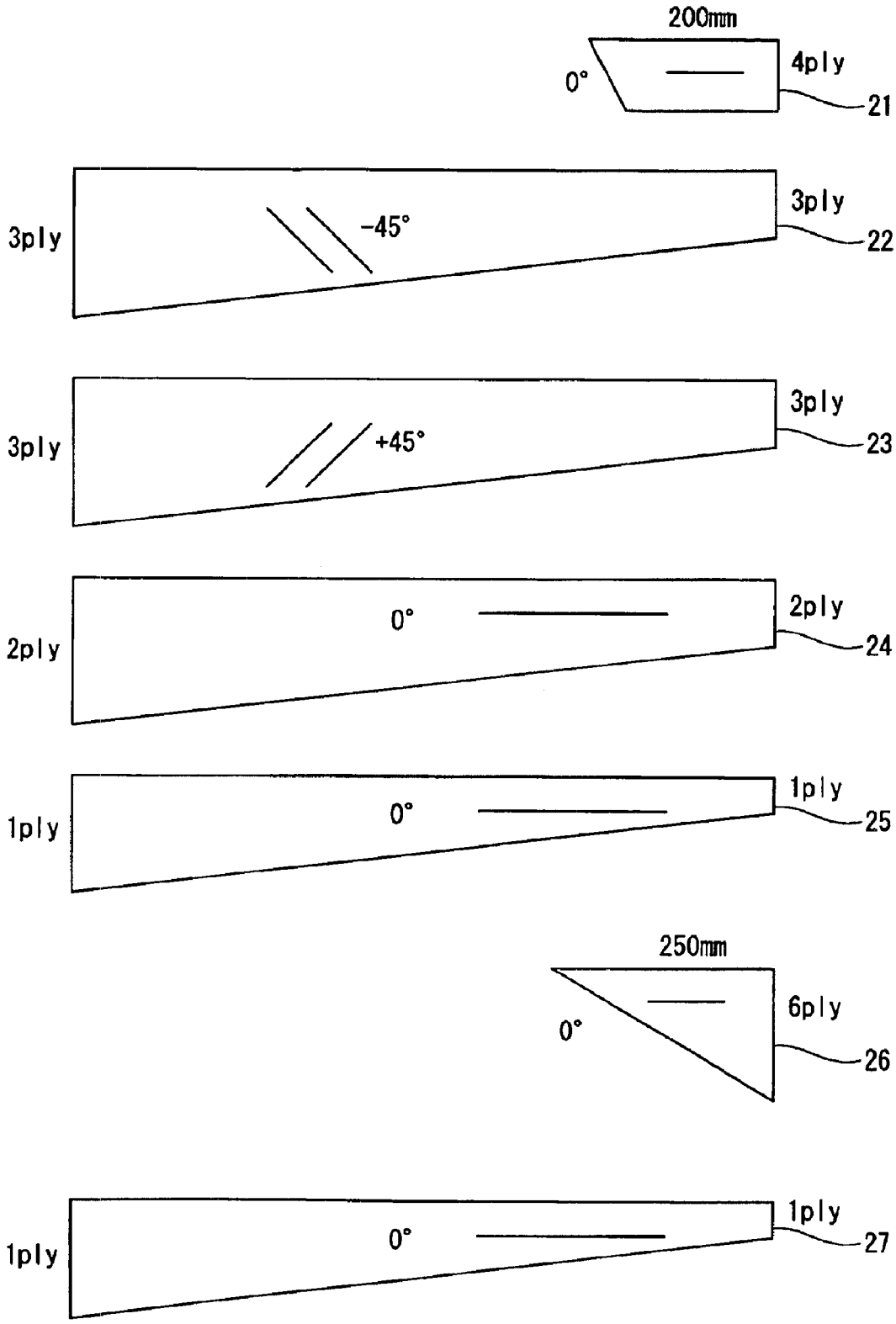
FIG. 3 shows prepregs for use in the golf club shaft of a second embodiment of the present invention.

FIG. 3 shows prepregs 21 through 27 composing the golf club shaft according to the second embodiment of the present invention.

The second embodiment is different from the first embodiment in that a straight-layer prepreg 26 disposed in the range of 250 mm from the tip of the shaft is interposed as an intermediate layer between an inner straight-layer prepreg 24, 25 and an outer straight-layer prepreg 27.

As the inner-side prepregs of the straight layer 24 and 25 to be disposed longitudinally entirely on the shaft, the same prepregs as the prepregs 14 and 15 of the first embodiment are used. As the outer-side prepreg of the straight layer 27 to be disposed longitudinally entirely on the shaft, the same prepreg as the prepreg 16 of the first embodiment is used.

The intermediate-layer prepreg 26 to be interposed between the inner-side prepreg of the straight layer 25 and the outer-side prepreg of the straight layer 27 contains a low-elastic-modulus pitch based carbon fiber reinforced prepreg having a high compressive break strain. The tensile modulus of elasticity of the low-elastic-modulus pitch based carbon fiber reinforced prepreg is in the range of 50 GPa to 150 GPa.

Figure 4:
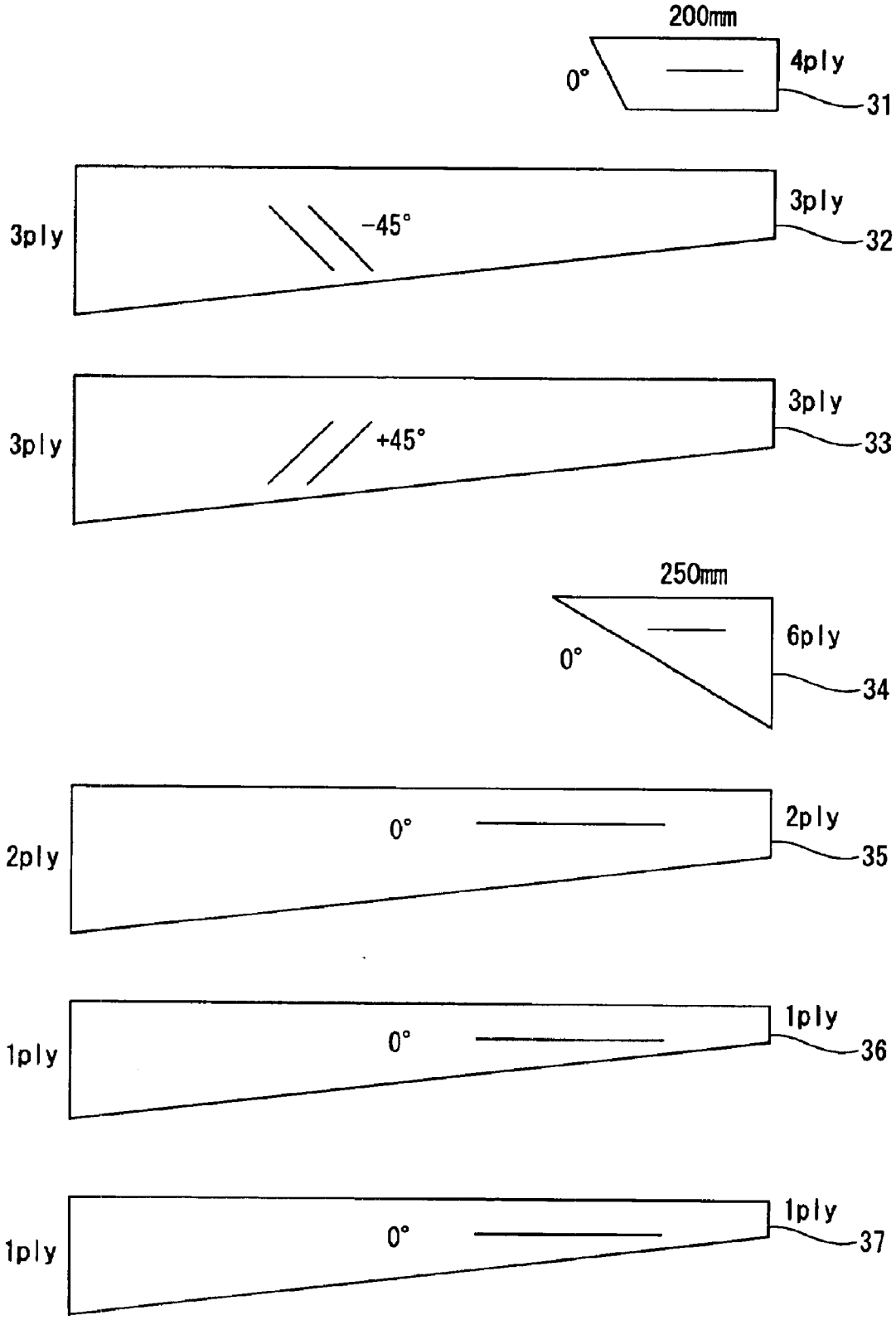
FIG. 4 shows prepregs for use in the golf club shaft of a third embodiment of the present invention.

FIG. 4 shows prepregs 31 through 37 composing the golf club shaft according to the third embodiment of the present invention. The third embodiment is different from the second embodiment in that a prepreg 34 containing the low-elastic-modulus pitch based carbon fiber reinforced prepreg is disposed at the inner side of prepreg 35 of an inner straight-layer.

EXAMPLES OF EXPERIMENTS

Golf club shafts of examples 1 through 4 and comparison examples 1 through 3 were prepared to measure the flexing amount thereof by a flex standard measuring method. The flexural strength and impact strength thereof were also measured.

The golf club shaft of the examples 1 and 2 had the same constructions as that of the golf club shaft of the first and second embodiments respectively.

The golf club shaft of the examples 3 and 4 had the same constructions as that of the golf club shaft of the third embodiment respectively.

The golf club shaft of the comparison example 1 had a conventional construction and the same laminating structure as that of the golf club shaft of the first embodiment except that the outer-side prepreg of the straight layer 17 was the same as the inner-side prepregs of the straight layer 15 and 16.

The golf club shaft of the comparison example 2 had the same laminating structure as that of the golf club shaft of the second embodiment except that the outer-side prepreg of the straight layer 27 was the same as the inner-side prepregs of the straight layer 24 and 25. More specifically, all of the three straight-layer prepregs contained reinforcing carbon fibers having an intermediate tensile modulus of elasticity and a high tensile strength. The same low-elastic-modulus pitch based carbon fiber reinforced prepreg 26 as that of the second embodiment was interposed between the prepregs 25 and 27.

The golf club shaft of the comparison example 3 had the same laminating structure as that of the embodiment 2. However, all of the straight-layer prepregs 24, 25, and 27 reinforced by the same carbon fiber having an intermediate tensile modulus of elasticity and a high tensile strength, similarly to the comparison example 2. The intermediate-layer prepreg 26 interposed between the prepregs 25 and 27 was the same as the prepregs 24, 25, and 27.

The prepregs shown in table 1 were used as the prepregs 11 to 17, 21 to 27, and 31 to 37. The properties of these prepregs are as shown in table 2.

Table 3 shows the length and weight, the ratio of its weight to its length, the diameter of the golf club shaft at its front end (diameter of tip), the diameter of the golf club shaft at its rear end (diameter of grip), the percentage of the outer straight layer to the straight layer of the golf club shaft of each of examples 1 through 4 and comparison examples 1 through 3.

TABLE 1

Material for Prepregs

| Sheet No. | CE1 | E1 | E2 | E3 | E4 | CE2 | CE3 |
|---|---|---|---|---|---|---|---|
| 11 | 8255S | 8255S | | 8255S | | | |
| 12 | 9255S | 9255S | | 9255S | | | |
| 13 | 9255S | 92553 | | 9255S | | | |
| 14 | 8255S | 8255S | | 8255S | | | |
| 15 | 8255S | 8255S | | 82553 | | | |
| 16 | 8255S | 3255G | | 3255G | | | |
| 17 | 8255S | 8255S | | E1026C | | | |
| 21 | | | 8255S | | | 8255S | 8255S |
| 22 | | | 9255S | | | 9255S | 9255S |
| 23 | | | 9255S | | | 9255S | 9255S |
| 24 | | | 8255S | | | 8255S | 8255S |
| 25 | | | 8255S | | | 8255S | 8255S |
| 26 | | | E1026C | | | E1026C | 8255S |
| 27 | | | 3255G | | | 8255S | 8255S |
| 31 | | | | | 8255S | | |
| 32 | | | | | 9255S | | |
| 33 | | | | | 9255S | | |
| 34 | | | | | E1026C | | |
| 35 | | | | | 8255S | | |
| 36 | | | | | 8255S | | |
| 37 | | | | | 3255G | | |

where E denotes embodiment and CE denotes comparison example.

TABLE 2

Table of Material

| Kind of prepreg | Property of carbon fiber: Kind of fiber | Tensile modulus of elasticity Gpa | Tensile strength Mpa | Property of composite material: Tensile break strain % | Compressive break strain % | Content of resin % | Name of company |
|---|---|---|---|---|---|---|---|
| 3255G | T700GC | 230 | 4900 | 1.84 | 1.41 | 25 | Toray Industries, Inc. |
| 9255S | M40J | 377 | 4410 | 1.1 | 0.5 | 25 | Toray Industries, Inc. |
| 8255S | M30S | 294 | 5490 | 1.6 | 1.0 | 25 | Toray Indusrries, Inc. |
| E1026C | XN-10 | 110 | 1900 | 1.46 | 2.1 | 33 | NGF Inc. |

TABLE 3

Example and Comparison Example

| | Length L mm | Weight W g | W/L g/mm | Diameter of shaft at tip ϕ mm | Diameter of shaft at grip ϕ mm | Percentage of outer straight layer to straight layer % | FLEX: Forward measuring method mm | FLEX: Rearward measuring method mm | Three-point flexural strength T N | A N | B N | C N | Impact strength J |
|---|---|---|---|---|---|---|---|---|---|---|---|---|---|
| CE1 | 1168 | 50 | 0.043 | 9.0 | 15.6 | — | 118 | 110 | 1750 | 560 | 650 | 840 | 4.03 |
| E1 | 1168 | 51 | 0.044 | 9.0 | 15.6 | 25.5 | 118 | 111 | 1880 | 690 | 840 | 990 | 4.51 |
| E2 | 1168 | 51 | 0.044 | 9.0 | 15.6 | 25.5 | 118 | 113 | 1970 | 760 | 840 | 990 | 5.33 |
| E3 | 1168 | 51 | 0.044 | 9.0 | 15.6 | 25.5 | 118 | 113 | 1820 | 610 | 840 | 990 | 5.18 |
| E4 | 1168 | 51 | 0.044 | 9.0 | 15.6 | 25.5 | 118 | 112 | 1850 | 670 | 840 | 990 | 4.92 |
| CE2 | 1168 | 50 | 0.043 | 9.0 | 15.6 | — | 118 | 113 | 1770 | 580 | 650 | 840 | 4.55 |
| CE3 | 1168 | 50 | 0.043 | 9.0 | 15.6 | — | 118 | 110 | 1750 | 560 | 650 | 840 | 4.01 |

where E denotes example and CE denotes comparison example.

The flexed amount of the golf club shaft of each of examples 1 through 4 and comparison examples 1 through 3 was measured at 45" position in the flex standard measuring method.

Figure 5A:
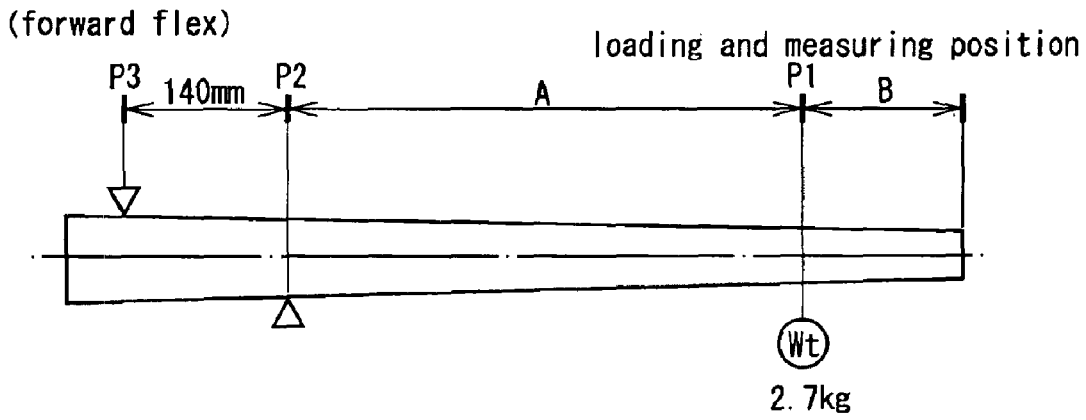
FIGS. 5A and 5B show a flex-measuring method.

In the forward flex-measuring method shown in FIG. 5A, a weight of 2.7 kg was hung at a position P1 spaced at an interval B (129 mm) from the tip. A position P2 spaced at an interval A (824 mm) from the position P1 and a position P3 spaced at 140 mm from the position P2 were supported. In this condition, the flexed amount of each golf club shaft was measured at the position P1 of the tip side.

Figure 5B:
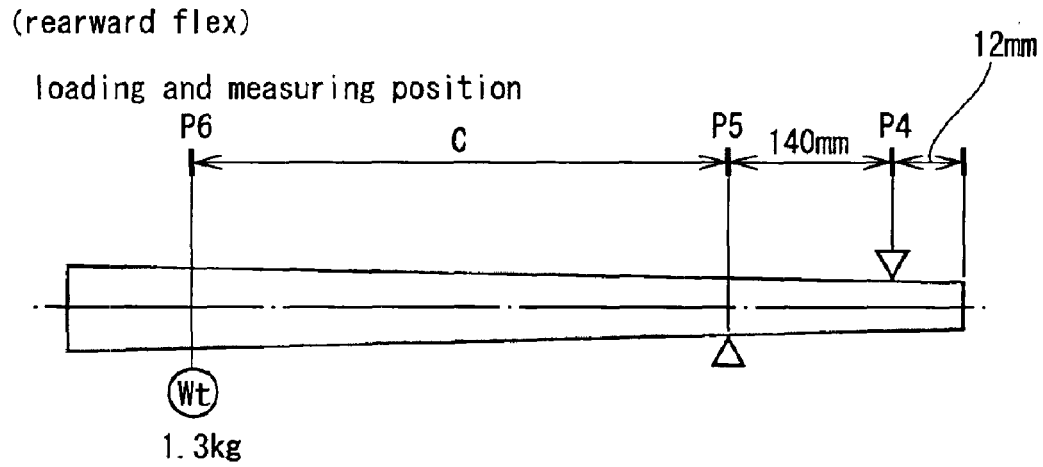

In the rearward flex-measuring method shown in FIG. 5B, a position P4 spaced at 12 mm from the tip and a position P5 spaced at 140 mm from the position P4 were supported. A weight of 1.3 kg was hung at a position P6, disposed at the grip side, spaced at an interval C (776 mm) from the position P5. In this condition, the flexed amount of each golf club shaft was measured at the position P6 of the grip side.

The flexural strength was measured by using a method based on the three-point bending test of "The standard of authorizing a golf club shaft and method of confirming the standard" (No.2087 of Section 5 admitted by the Minister of International Trade and Industry) provided by Products Safety Association.

Figure 6:
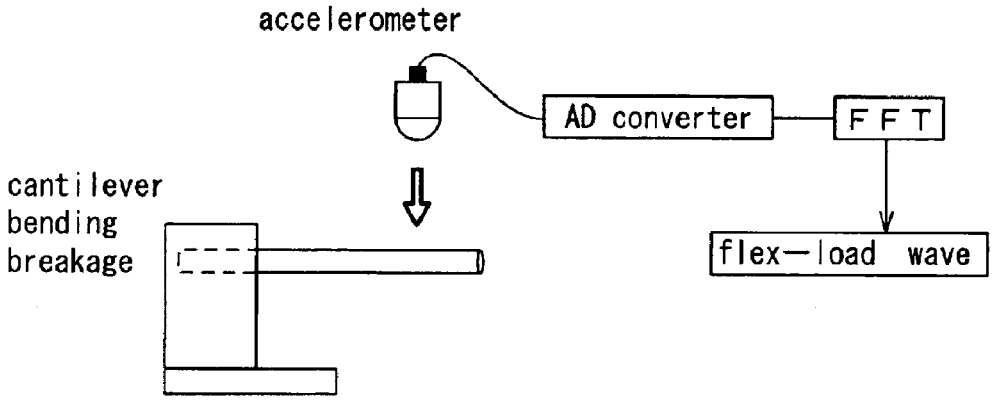
FIG. 6 shows a method of measuring an impact strength.

As shown in FIG. 6, the impact strength of each golf club shaft was measured by conducting a cantilever bending impact test by using a drop weight impact tester (IITM-18) manufactured by Yonekura Seisakusho Inc.

Figure 7:
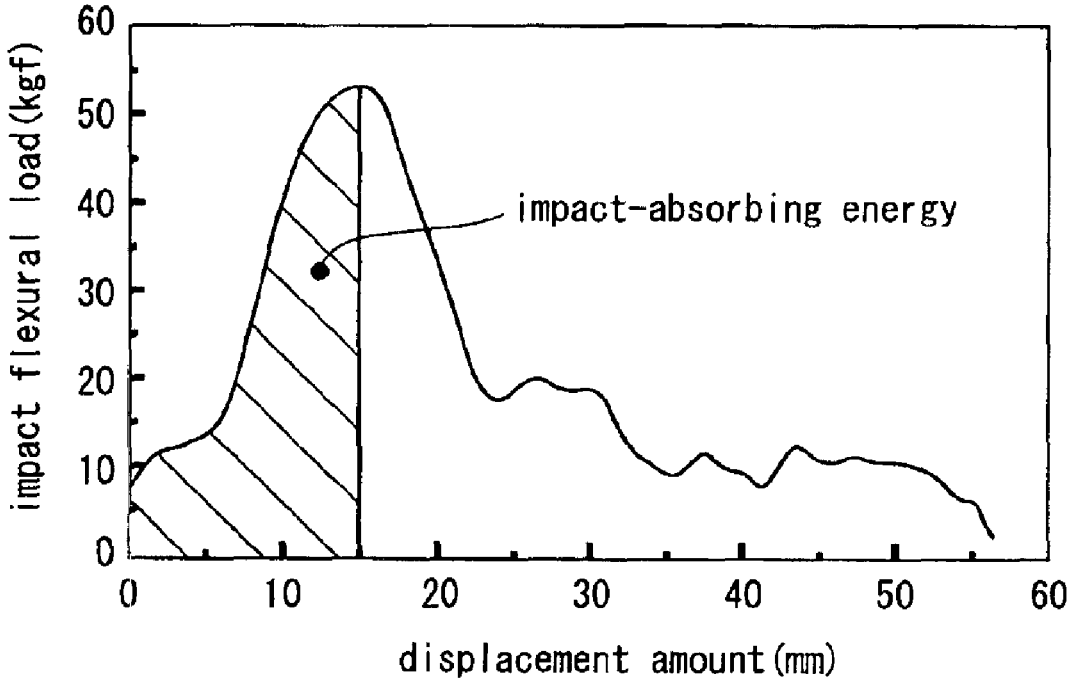
FIG. 7 shows the correlation between an impact flexural load applied to a golf club shaft and a displacement amount thereof.

In the impact test, a shaft S was fixed at a position 50 mm spaced from the tip. A weight W of 800 g was dropped to the shaft S at a position 100 mm spaced from the fixed position from a level located at 1500 mm above the fixed position to apply an impact load to the shaft S. An accelerometer mounted on the weight W was connected to an FFT through an AD converter. As shown in FIG. 7, an impact flexural load applied to the shaft S and a displacement amount thereof were measured to compute an impact-absorbing energy before breakage of the shaft S started.

Table 3 shows the flex, three-point flexural strength, and impact strength of the golf club shaft of each of the examples 1 through 4 and the comparison examples 1 through 3.

As shown in table 3, in the golf club shaft of the example 1, the outer-side prepreg 16 of the straight layer had a higher tensile break strain than the inner-side prepregs 14 and 15 of the straight layer. Thus it was confirmed that the golf club shaft of the example 1 was higher in its three-point flexural strength and impact strength than those of the golf club shaft of the comparison example 1 in which the material for the outer-side prepreg was the same as that for the inner-side prepreg.

In the golf club shaft of the example 2, the low-elastic-modulus pitch based carbon fiber reinforced prepreg 26 was interposed between the inner-side prepreg of the straight layer 25 and the outer-side prepreg of the straight layer 27. Therefore the shaft had the highest three-point flexural strength and impact strength.

In the golf club shaft of the example 3, the low-elastic-modulus pitch based carbon fiber reinforced prepreg 17 was disposed on the outer surface of the outer-side prepreg of the straight layer. In the golf club shaft of the example 4, the low-elastic-modulus pitch based carbon fiber reinforced prepreg 33 was disposed on the inner surface of the inner-side prepreg of the straight layer. Thus the shaft of each of the examples 3 and 4 had higher three-point flexural strength and impact strength than the shaft of the comparison examples 1 and 3 not provided with the low-elastic-modulus pitch based carbon fiber reinforced prepreg. However the shaft of each of the examples 3 and 4 had lower three-point flexural strength and impact strength than the shaft of the example 2 having the low-elastic-modulus pitch based carbon fiber reinforced prepreg interposed between the inner-side prepreg of the straight layer and the outer-side prepreg of the straight layer. Therefore it was confirmed that the construction of the shaft of the example 2 was most favorable.

In the shaft of the comparison example 2, the outer-side prepregs of the straight layer, 24, 25, and 27 was composed of the same material. That is, all of three straight-layer prepregs 24, 25, and 27 were composed of the carbon fiber having an intermediate tensile modulus of elasticity and a high tensile strength. The material for the inner-side prepreg of the straight layer was not different from that for the outer-side prepreg of the straight layer. Thus even though the low-elastic-modulus pitch based carbon fiber reinforced prepreg was interposed between the inner-side prepreg of the straight layer and the outer-side prepreg of the straight layer, it was confirmed that the shaft had a high impact strength, but did not have a sufficient three-point flexural strength.

The golf club shaft of the comparison example 3 had the same laminating structure as that of the golf club shaft of the embodiment 2. As the reinforcing layer at the tip of the shaft, the straight-layer prepreg 26 was interposed between the inner-side prepreg of the straight layer 25 disposed longitudinally entirely on the shaft and the outer-side prepreg of the straight layer 27 disposed longitudinally entirely thereon. However, all of the straight-layer prepregs 25, 26, and 27 were composed of the same carbon fiber having an intermediate tensile modulus of elasticity and a high tensile strength. That is, the material for the inner-side prepreg of the straight layer 25 was not different from that for the outer-side prepreg of the straight layer 27. Further the material for the prepreg 26 interposed as the intermediate layer between the inner-side prepreg of the straight layer 25 and the outer-side prepreg of the straight layer 27 was also the same as the material for the prepregs 25 and 27. The material for the prepregs 25, 26, and 27 was not the low-elastic-modulus pitch based carbon fiber reinforced prepreg. Therefore the shaft of the comparison example 3 was lowest in the three-point flexural strength and the impact strength.

As apparent from the foregoing description, in the golf club shaft of the present invention, the straight layer has a plurality of prepregs. The prepreg at the inner side of the straight layer is reinforced by carbon fiber having an intermediate elasticity and a high strength and does not contain the reinforcing carbon fiber having a high modulus of elasticity. Thus the prepreg at the inner side of the straight layer has a sufficient rigidity. The tensile break strain of the outer-side prepreg of the straight layer is set higher than that of the inner-side prepreg of the straight layer. Therefore although the inner-side prepreg of the straight layer contains the reinforcing carbon fiber having an intermediate elasticity, the shaft has a high compressive strength and is provided with a sufficient reinforcing effect.

Thereby they have found that while keeping the shaft lightweight, soft, sufficiently rigid, it is possible to improve the flexural strength and impact strength thereof to thereby prevent it from being broken, without using a specific expensive prepreg.

The impregnation degree of resin of each of the prepreg of the straight layer and that of the prepreg of the angular layer are set to the range of 15 wt % to 30 wt %. The ratio of the weight of the shaft to the length thereof is set to less than 0.05 g/mm. Thus it is possible to provide a lightweight golf club shaft.

In the range of at least 100 mm from the tip of the golf club shaft, the intermediate layer composed of the pitch based low-elastic-modulus carbon fiber reinforced prepreg having a high compressive break strain is interposed between the inner-side prepreg of the straight layer and the outer-side prepreg of the straight layer. Contrary to the other carbon fibers, the low-elastic-modulus pitch based carbon fiber has a characteristic that its compressive strength is higher than its tensile strength. Thus by disposing the low-elastic-modulus pitch based carbon fiber reinforced prepreg in the above-described regions, the strength of the compressive side is increased. Consequently the tensile strength and the compressive strength balance properly. Thereby it is possible to improve the flexural strength of the shaft and its impact strength.

What is claimed is:

1. A golf club shaft comprising a laminate of prepregs composed of a resin and a reinforcing fiber impregnated with said resin, comprising:

an angular layer composed of prepregs in which said reinforcing fiber inclines to an axis of said golf club shaft, wherein said angular layer is disposed substantially along the entire length of the shaft;

a plurality of straight layers disposed outside said angular layer and composed of prepregs in which said reinforcing fiber is disposed substantially parallel with said axis of said golf club shaft, wherein said plurality of straight layers is disposed substantially along the entire length of the shaft; and wherein said reinforcing fiber of said prepreg at an inner side of said plurality of straight layers has a tensile modulus of elasticity in a range of 280 to 380 GPa and a tensile strength in a range of 4400 to 6500 MPa, and wherein a tensile break strain of said prepreg at an outer side of said plurality of straight layers is set to not less than 1.8% and higher than that of said prepreg at said inner side of said plurality of straight layers which is set to a range of 1.0% to 1.6%.

2. The golf club shaft according to claim 1, wherein said reinforcing fiber of said prepregs of said straight layers forms an angle of less than ±15° to an axis of said shaft; and said reinforcing fiber of said prepregs of said angular layer forms an angle of not less than ±25° nor more than ±60° to said axis of said shaft, and an impregnation degree of resin of each of said prepregs of said straight layers and that of said prepregs of said angular layer are set to a range of 15 wt % to 30 wt %.

3. The golf club shaft according to claim 2, wherein a ratio of a weight of said outer prepreg of said straight layers to a total weight of all prepregs of said straight layers is set to a range of 15 wt % to 35 wt %.

4. The golf club shaft according to claim 2, wherein a ratio of a weight of said shaft to a length thereof is set to less than 0.05 g/mm.

5. The golf club shaft according to claim 2, wherein said angular layer and plurality of straight layers are disposed along not less than 90% of the shaft.

6. The golf club shaft according to claim 1, wherein a ratio of a weight of said outer prepreg of said straight layers to a total weight of all prepregs of said straight layers is set to a range of 15 wt % to 35 wt %.

7. The golf club shaft according to claim 1, wherein a ratio of a weight of said shaft to a length thereof is set to less than 0.05 g/mm.

8. The golf club shaft according to claim 1, wherein said angular layer and plurality of straight layers are disposed along not less than 90% of the shaft.

9. A golf club shaft, comprising a laminate of prepregs composed of a resin and a reinforcing fiber impregnated with said resin, comprising:

an angular layer composed of prepregs in which said reinforcing fiber inclines to an axis of said golf club shaft, wherein said angular layer is disposed substantially along the entire length of the shaft;

a plurality of straight layers disposed outside said angular layer and composed of prepregs in which said reinforcing fiber is disposed substantially parallel with said axis of said golf club shaft, wherein said plurality of straight layers is disposed substantially along the entire length of the shaft; and wherein said reinforcing fiber of said prepreg at an inner side of said plurality of straight layers has an intermediate elasticity and a high strength, and wherein a tensile break strain of said prepreg at an outer side of said plurality of straight layers is set higher than that of said prepreg at said inner side of said plurality of straight layers; and wherein in a range of at least 100 mm from a tip of said golf club shaft, an intermediate layer composed of a pitch based low-elastic-modulus carbon fiber reinforced prepreg having a high compressive break strain is interposed between an inner-side prepreg of said straight layers and an outer-side prepreg of said straight layers; disposed on an inner surface of said inner-side prepreg of said straight layers; or disposed on an outer surface of said outer-side prepreg of said straight layers.

10. The golf club shaft according to claim 9, wherein said pitch based low-elastic-modulus carbon fiber reinforced prepreg is interposed between said inner-side prepreg of said straight layers and said outer-side prepreg of said straight layers; and said pitch based carbon low-elastic-modulus fiber reinforced prepreg contains a low-elastic-modulus pitch based carbon fiber having a tensile modulus of elasticity in a range of 50 GPa to 150 GPa.

11. The golf club shaft according to claim 9, wherein a ratio of a weight of said outer prepreg of said straight layers to a total weight of all prepregs of said straight layers is set to a range of 15 wt % to 35 wt %.

12. The golf club shaft according to claim 9, wherein a ratio of a weight of said shaft to a length thereof is set to less than 0.05 g/mm.

13. The golf club shaft according to claim 9, wherein said angular layer and plurality of straight layers are disposed along not less than 90% of the shaft.

14. A golf club shaft, comprising a laminate of prepregs composed of a resin and a reinforcing fiber impregnated with said resin, comprising:

an angular layer composed of prepregs in which said reinforcing fiber inclines to an axis of said golf club shaft, wherein said angular layer is disposed substantially along the entire length of the shaft;

a plurality of straight layers disposed outside said angular layer and composed of prepregs in which said reinforcing fiber is disposed substantially parallel with said axis of said golf club shaft, wherein said plurality of straight layers is disposed substantially along the entire length of the shaft; and wherein said reinforcing fiber of said prepreg at an inner side of said plurality of straight layers has an intermediate elasticity and a high strength, and wherein a tensile break strain of said prepreg at an outer side of said plurality of straight layers is set higher than that of said prepreg at said inner side of said plurality of straight layers; and wherein said reinforcing fiber of said prepregs of said straight layers forms an angle of less than ±15° to an axis of said shaft; and said reinforcing fiber of said prepregs of said angular layer forms an angle of not less than ±25° nor more than ±60° to said axis of said shaft, and an impregnation degree of resin of each of said prepregs of said straight layers and that of said prepregs of said angular layer are set to a range of 15 wt % to 30 wt %; and wherein in a range of at least 100 mm from a tip of said golf club shaft, an intermediate layer composed of a pitch based low-elastic-modulus carbon fiber reinforced prepreg having a high compressive break strain is interposed between an inner-side prepreg of said straight layers and an outer-side prepreg of said straight layers; disposed on an inner surface of said inner-side prepreg of said straight layers; or disposed on an outer surface of said outer-side prepreg of said straight layers.

15. The golf club shaft according to claim 14, wherein said pitch based low-elastic-modulus carbon fiber reinforced prepreg is interposed between said inner-side prepreg of said straight layers and said outer-side prepreg of said straight layers; and said pitch based carbon low-elastic-modulus fiber reinforced prepreg contains a low-elastic-modulus pitch based carbon fiber having a tensile modulus of elasticity in a range of 50 GPa to 150 GPa.

16. The golf club shaft according to claim 14, wherein a ratio of a weight of said outer prepreg of said straight layers to a total weight of all prepregs of said straight layers is set to a range of 15 wt % to 35 wt %.

17. The golf club shaft according to claim 14, wherein a ratio of a weight of said shaft to a length thereof is set to less than 0.05 g/mm.

18. The golf club shaft according to claim 14, wherein said angular layer and plurality of straight layers are disposed along not less than 90% of the shaft.

* * * * *